US007357079B2

(12) United States Patent
Rachor et al.

(10) Patent No.: US 7,357,079 B2
(45) Date of Patent: Apr. 15, 2008

(54) PRINTING GROUP OF A PRINTING UNIT, CONSISTING OF TWO PRINTING GROUPS PLACED VERTICALLY ABOVE EACH OTHER IN A PRINTING MACHINE

(75) Inventors: Burkhard Hubert Heinrich Rachor, Kürnach (DE); Helmut Holm, Erlabrunn (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 56 days.

(21) Appl. No.: 10/549,121

(22) PCT Filed: Mar. 5, 2004

(86) PCT No.: PCT/EP2004/050258

§ 371 (c)(1),
(2), (4) Date: Sep. 14, 2005

(87) PCT Pub. No.: WO2004/080716

PCT Pub. Date: Sep. 23, 2004

(65) Prior Publication Data

US 2006/0174786 A1 Aug. 10, 2006

(30) Foreign Application Priority Data

Mar. 14, 2003 (DE) ..... 103 11 285

(51) Int. Cl.
*B41F 7/02* (2006.01)

(52) U.S. Cl. ..... 101/217; 101/142; 101/177; 101/183; 101/477

(58) Field of Classification Search ..... None
See application file for complete search history.

(56) References Cited

U.S. PATENT DOCUMENTS

| | | | | |
|---|---|---|---|---|
| 2,003,800 | A * | 6/1935 | Barber | 101/177 |
| 3,196,788 | A | 7/1965 | Knowles | |
| 4,222,325 | A * | 9/1980 | Edwards | 101/137 |
| 4,796,556 | A * | 1/1989 | Bird | 118/46 |
| 4,852,485 | A * | 8/1989 | Brunner | 101/211 |

(Continued)

FOREIGN PATENT DOCUMENTS

DE 19934271 A1 5/2000

(Continued)

*Primary Examiner*—Jill E. Culler
(74) *Attorney, Agent, or Firm*—Jones, Tullar & Cooper, P.C.

(57) ABSTRACT

A printing unit consists of at least two printing groups, which are placed vertically above each other, in a printing machine. Each of the printing groups includes a printing cylinder, an inking unit with at least one inking roller, a dampening unit with several dampening rollers arranged in a line, and a transfer cylinder that cooperates with the printing cylinder. The inking cylinder and the dampening roller, in an operational state in which they are adjacent the printing cylinder, form an obtuse opening angle with the printing cylinder. The rollers of the dampening unit are arranged with at least the first and last rollers in the roller train arranged inside an acute angle depending from the transfer cylinder. A horizontal line extending from the transfer cylinder defines an opening angle of less than 45° with the rollers of the dampening unit. A printing forme is fed to the printing cylinder through an obtuse angle between the dampening roller and the inking roller.

37 Claims, 7 Drawing Sheets

U.S. PATENT DOCUMENTS

| | | | | |
|---|---|---|---|---|
| 4,953,461 | A | 9/1990 | Gaffney et al. | |
| 4,967,660 | A * | 11/1990 | Yamanari et al. | 101/229 |
| 5,473,983 | A * | 12/1995 | Maul | 101/217 |
| 6,345,575 | B1 | 2/2002 | Metrope | |
| 6,363,848 | B1 * | 4/2002 | Weschenfelder | 101/138 |
| 6,408,747 | B2 | 6/2002 | Koppelkamm et al. | |
| 6,450,096 | B1 | 9/2002 | Koppelkamm et al. | |
| 6,557,464 | B2 * | 5/2003 | Kaser et al. | 101/143 |
| 6,615,731 | B2 | 9/2003 | Dumais et al. | |
| 6,655,283 | B2 | 12/2003 | Deslangle et al. | |
| 2002/0005129 | A1 * | 1/2002 | Nagano et al. | 101/382.1 |
| 2004/0250717 | A1 * | 12/2004 | Masuch et al. | 101/179 |

FOREIGN PATENT DOCUMENTS

| | | | |
|---|---|---|---|
| DE | 19947173 | A1 | 4/2001 |
| DE | 10003290 | A1 | 8/2001 |
| DE | 10120134 | A1 | 11/2001 |
| DE | 29924330 | U1 | 10/2002 |
| DE | 10219073 | A1 | 11/2002 |
| EP | 1 155 840 | A2 | 11/2001 |
| WO | WO 02/081219 | A2 | 10/2002 |
| WO | WO 03/016058 | A1 | 2/2003 |

* cited by examiner

PRINTING GROUP OF A PRINTING UNIT, CONSISTING OF TWO PRINTING GROUPS PLACED VERTICALLY ABOVE EACH OTHER IN A PRINTING MACHINE

CROSS-REFERENCE TO RELATED APPLICATIONS

This application is the U.S. national phase, under 35 U.S.C. 371, of PCT/EP 2004/050258, filed Mar. 5, 2004; published as WO 2004/080716 A1 on Sep. 23, 2004 and claiming priority to DE 103 11 285.5, filed Mar. 14, 2003, the disclosures of which are-expressly incorporated herein by reference.

FIELD OF THE INVENTION

The present invention is directed to a printing group of a printing unit of a printing press, which printing press has at least two printing groups arranged vertically above each other, and to a printing group. Each printing group includes a forme cylinder, a cooperating transfer cylinder, an inking system and a dampening system which are positioned to facilitate access to the forme cylinder.

BACKGROUND OF THE INVENTION

An offset rotary printing press is known from DE 100 03 290 A1. One, or several rollers of an inking system, which is assigned to a forme cylinder, are pivotable in order to create a clear working space in connection with a dampening system which is also assigned to the same forme cylinder.

A printing group of a printing press is known from WO 02/081219. In an embodiment represented in FIG. 1 of this document, in their operational state, in which they are placed against a forme cylinder, a cross section through the respective centers of an ink application roller of an inking system and through a dampening fluid application roller of a dampening system form an obtuse opening angle. A transfer cylinder, which is working together with the forme cylinder, has a circumference of twice the size of the forme cylinder. In a preferred embodiment of this prior device, transfer cylinders in an H-printing unit have been placed against each other in pairs in the horizontal direction. The center of one of the ink application rollers forms an acute opening angle, starting at the forme cylinder, with the center of a dampening fluid application roller arranged next to this ink application roller. A material to be imprinted is conducted in a vertical run between transfer cylinders which have been placed against each other. This prior art document does not provide any discussion regarding the way in which a printing forme is conducted to the forme cylinder.

A printing group in a U-printing unit of a printing press, through which the material to be imprinted runs-vertically, is known from U.S. Pat. No. 3,196,788. Two ink application rollers of an inking system and two dampening fluid rollers of a dampening system have been placed against a forme cylinder of the printing group. A center of one of the ink application rollers forms an obtuse opening angle, starting at the forme cylinder, with the center of a dampening fluid application roller which is arranged closest to this ink application roller. Access to the forme cylinder is possible within this opening angle. The forme cylinder, and the transfer cylinder which is assigned to it, each have a diameter of approximately the same size. The dampening system and the inking system each has a roller train, each of which contains several rollers. The roller trains are each arranged substantially in the vertical direction.

SUMMARY OF THE INVENTION

The object of the present invention is directed to providing a printing group of a printing unit of a printing press, which printing press has at least two printing groups located vertically above each other, and a printing unit.

In accordance with the present invention, this object is attained by the provision of a printing unit of a printing press that has at least two printing groups which are arranged vertically one above the other. Each printing group includes a forme cylinder and a cooperating transfer cylinder, an inking system and a dampening system. Both include at least one roller which contacts the forme cylinder. These systems are positioned to maximize an open area or free space on the forme cylinder so that the attachment of printing formes to the forme cylinder is made easier.

The advantage to be gained by the present invention lies, in particular, in that, in spite of a comparatively small diameter and with respectively at least one inking system roller, as well as a dampening system roller, placed against it, the forme cylinder of the printing group is easily accessible, in particular for accomplishing a change of a printing forme. In spite of the provision an folded suspension leg, which is formed at the leading edge of a printing forme brought to the forme cylinder, the printing forme can be dependably mounted in a groove provided in the shell face of the forme cylinder. Thus, set-up work or maintenance work at the forme cylinder are made easier. With all this, and because of a short distance between its print locations, which follow each other vertically, the printing unit, as a whole, has a low structural height. Therefore, the printing unit is compactly constructed in its structural height.

BRIEF DESCRIPTION OF THE DRAWINGS

Preferred embodiments of the present invention are represented in the drawings and will be described in greater detail in what follows.

Shown are in:

FIG. 1, a perspective representation of a printing forme, in

DESCRIPTION OF THE PREFERRED EMBODIMENT

Figure 1:
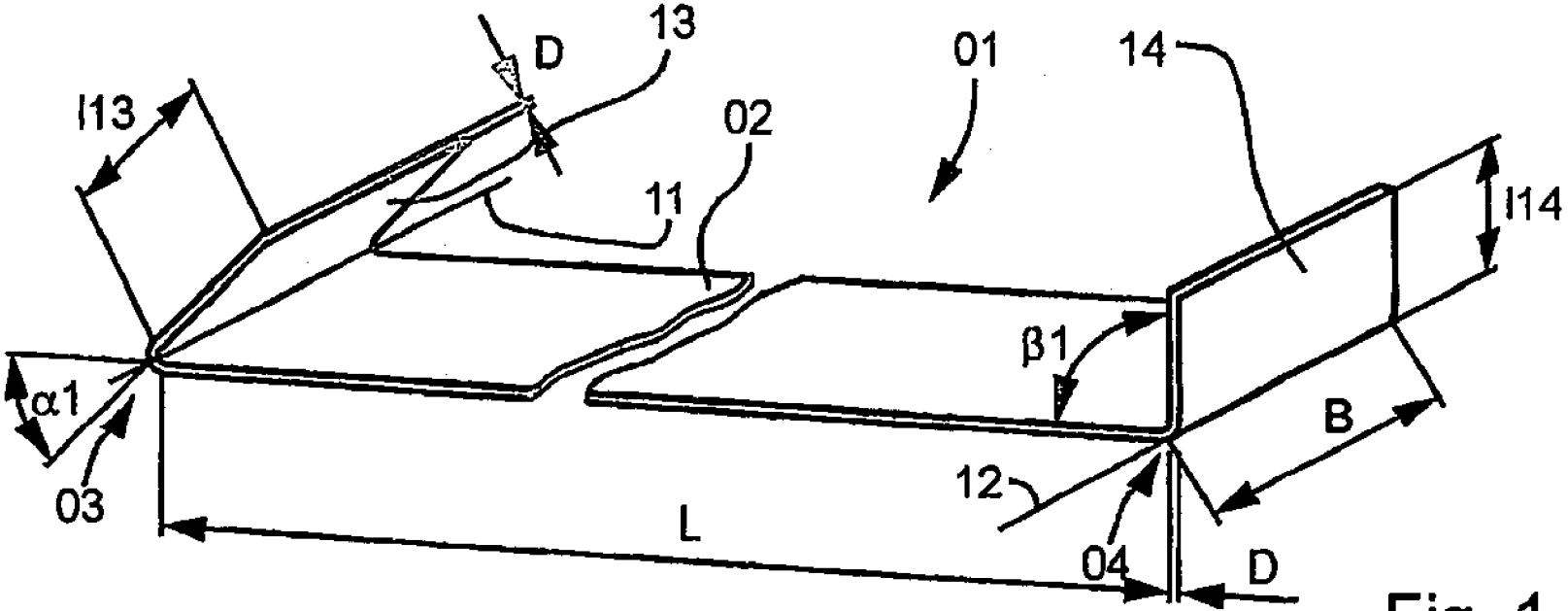
Figure 2:
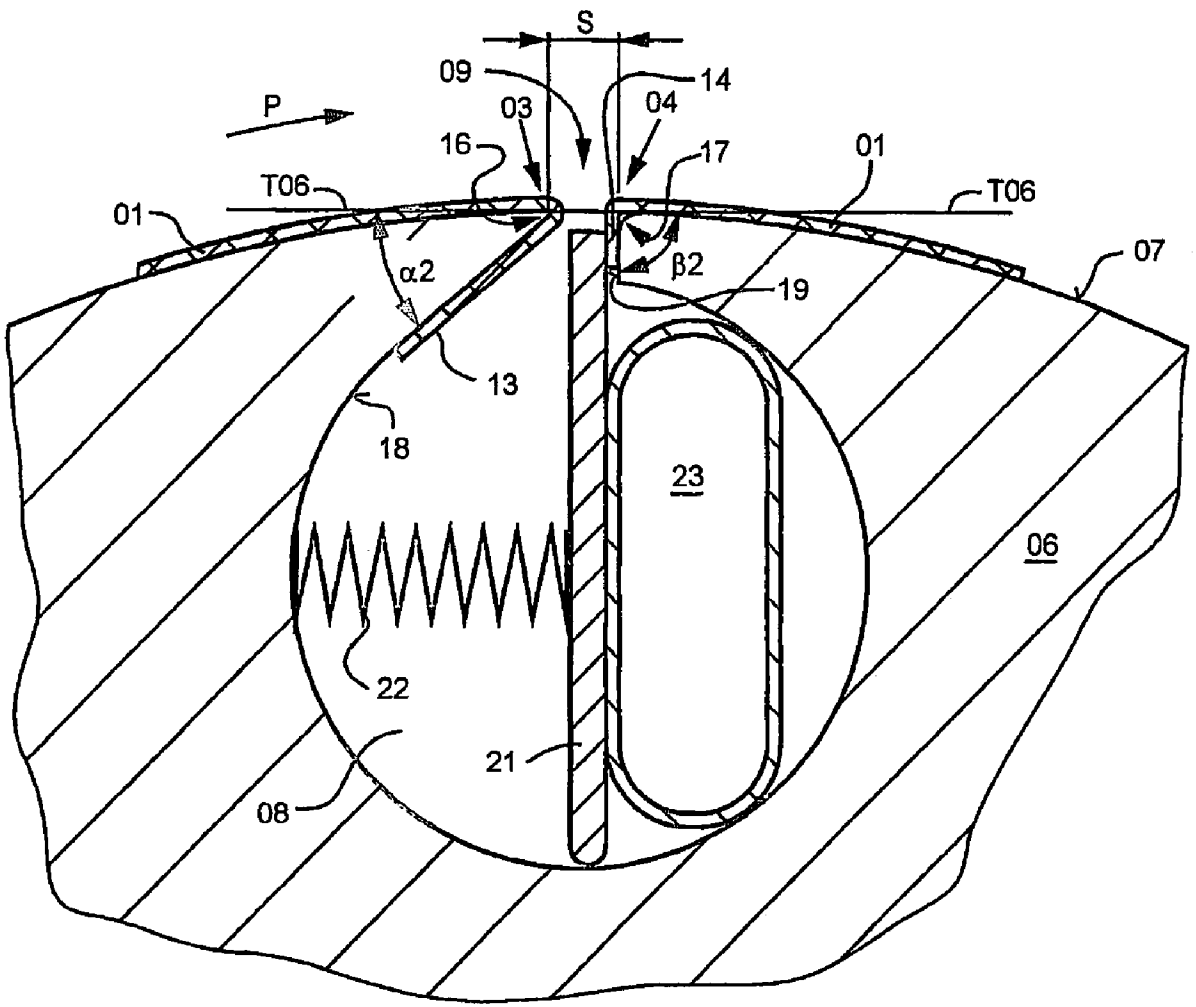
FIG. 2, a simplified cross-sectional representation of a holding device for securing a printing forme mounted on a forme cylinder, in FIG. 3, an H-printing unit of a printing press in accordance with the present invention, in FIG. 4, a portion of the printing unit depicted in FIG. 3, and with a printing forme brought to the forme cylinder, in FIG. 5, a portion of the printing unit depicted in FIG. 3, and with a printing forme with a suspension leg engaging an opening of the forme cylinder, in FIG. 6, a portion of a printing unit similar to the one depicted in FIG. 3, with a pressure element arranged on the forme cylinder and with a printing forme being brought to the forme cylinder, and in FIG. 7, a portion of a printing unit similar to the one depicted in FIG. 3, with a pressure element arranged on the forme cylinder and with a suspension leg of a printing forme engaging an opening of the forme cylinder.

As can be seen from FIG. 1, a plate-shaped printing forme 01 has a substantially rectangular surface of a length L and a width B wherein, for example, the length L can assume values between 400 mm and 900 mm, and preferably between 470 mm to 630 mm, and the width B has a value of, for example, at least 250 mm. The surface has a contact side, which is called contact face 02 in the discussion which follows, and which, in the mounted state the printing forme 01, rests on a shell face 07 or surface of a forme cylinder 06 of a printing press, as seen in FIG. 2. The shell face can have a width, in the axial direction of the forme cylinder 06, of, for example, up to 2300 mm, and preferably up to 1600 mm. The face which is obverse to the contact face 02 is a working face, which is provided with a print image, or which at least can be provided with a print image. The printing forme 01 has two ends 03, 04, located opposite each other, each preferably being provided with folded suspension legs 13, 14. These ends 03, 04 delimit the contact face 02, and the suspension legs 13, 14 each preferably extend entirely, or at least partially, over the width B of the printing forme 01. The contact face 02 of the printing forme 01 is flexible, at least along the length L, and, when the printing forme 01 is fastened on the shell surface 07 of the forme cylinder 06, it can be matched to the curvature of the forme cylinder 06, as seen in FIG. 2. In the mounted state of the printing forme 01, the length L of the contact face 02 thus extends in the direction of the circumference of the forme cylinder 06, while the width B of the contact face 02 extends in the axial direction of the forme cylinder 06.

As is represented in FIG. 2, the suspension legs 13, 14 of the printing forme 01 are, for example, secured by the operation of a holding device, such as, for example, a clamping device. The holding device is preferably arranged in a groove 08, which groove 08 typically extends in the axial direction of the forme cylinder 06. An end 03 of the printing forme 01, which end 03 is aligned with the production direction P of the forme cylinder 06, is called its leading edge 03, while the oppositely located end 04 of the printing forme 01 is the trailing end 04 of the printing forme 01. At least the ends 03, 04 of the printing forme 01, together with the suspension legs 13, 14 which are formed on ends 03, 04, are made of a rigid, material, such as, for example, a metallic material such as an aluminum alloy. Customarily, the thickness D of the material of the printing forme 01, as seen in FIG. 1, or the thickness D of the material of the suspension legs 13, 14, is a few tenths of a millimeter, such as, for example 0.2 mm to 0.4 mm, and is preferably 0.3 mm. Therefore, the printing forme 01 as a whole, or at least at its ends 03, 04, consists of a dimensionally stable material, so that the ends 03, 04 can be permanently deformed by being bent against a material specific resistance.

The folded suspension leg 13, 14 is formed on at least one end 03, 04 of the printing forme 01, as seen in FIG. 1, but is preferably formed at each of both ends 03, 04, along a bending edge 11, 12. These suspension legs 13, 14 can be inserted into a narrow, and in particular into a slit-shaped, opening 09, extending in the axial direction of the forme cylinder 06, of the groove 08, as seen in FIG. 2, which is arranged in the forme cylinder 06, and can be fastened in groove 08 by the use of a holding device. For example, with respect to the length L of the not-arched, flat contact face 02 of the not mounted printing forme 01, a suspension leg 13 at the end 03 of the printing forme 01 is bent at the bending edge 11 at an opening angle $\alpha 1$, or a suspension leg 14, at its end 04, is bent, at the bending edge 12, at an opening angle $\beta 1$, as seen in FIG. 1, wherein, as a rule, the opening angles $\alpha 1$, $\beta 1$ are between 30° and 140°. If the opening angle $\alpha 1$ is assigned to the leading edge 03 of the printing forme 01, it is preferably an acute angle and is, in particular, an acute angle of 45°. The opening angle $\beta 1$ at the trailing end 04 of the printing forme 01 is often made to be greater than 80° or is made to be obtuse. In particular, it is selected as either 85° or 135°. The folded suspension leg 13 at the leading edge 03 has a length l13 which, for example, lies in the range of 4 mm to 30 mm, and in particular lies between 4 mm and 15 mm. The folded suspension leg 14 at the trailing end 04 has a length l14 which, for example, lies between 4 mm and 30 mm, and in particular lies between 8 mm and 12 mm. The shorter length is preferred in order to assure as easy as possible a removal of the suspension legs 13, 14 out of the opening 09 of the groove 08.

In a simplified sectional representation, FIG. 2 shows a forme cylinder 06 with a shell face 07 and with a groove 08, which groove 08 has a narrow, slit-shaped opening 09 with a slit width S toward the shell face 07. The slit width S preferably is less than 5 mm and in particular lies within the range of 1 mm to 3 mm. In the production direction P of the forme cylinder 06, the opening 09 has a front edge 16 and a rear edge 17. Between a wall 18, which extends from the front edge 16 toward the groove 08 and an imaginary tangential line T06 resting on the opening 09 in the shell face 07 of the forme cylinder 06, an acute opening angle $\alpha 2$ is formed, which angle $\alpha 2$ lies between 30° and 50°, and preferably is 45°. The folded suspension leg 13 at the leading edge 03 of the printing forme 01 can therefore be suspended, preferably in a positive connection, at this front edge 16 of the opening 09, because the opening angle $\alpha 1$ at the leading edge 03 of the printing forme 01 is preferably matched to the opening angle $\alpha 2$. The same applies to the trailing end 04 of the printing forme 01. Between a wall 19, which is extending from the rear edge 17 of the opening 09 toward the groove 08, and an imagined tangential line T06, which is resting on the opening 09 in the shell face 07 of the forme cylinder 06, an opening angle $\beta 2$ is formed, which angle $\beta 2$ either lies between 80° and 95°, and is preferably 90°, or which lies between 120° and 150°, and is preferably 135°. Thus, the folded suspension leg 14 at the trailing end 04 of the printing forme 01 can be suspended, preferably by a positive connection, at this rear edge 17 of the opening 09, because the opening angle $\beta 1$ at the trailing end 04 of the printing forme 01 has been matched, at least approximately, to the opening angle $\beta 2$ at the groove opening 09.

At least one preferably pivotably supported holding device 21 and one preferably prestressed spring element 22 are arranged, for example, in the groove 08. The spring element 22 typically presses the holding device 21 against the folded suspension leg 14 at the trailing end 04, which trailing end suspension leg 14 has been suspended in the opening 09 on its rear edge 17. The suspension leg 14 at the trailing end 04 of forme 01 is held against the wall 19 extending from the rear edge 17 of groove opening 09 toward the groove 08.

To release the pressure which is exerted by the holding device 21, an actuating element 23 is provided in the groove 08 which, when actuated, pivots the holding device 21 against the force of the spring element 22. Thus, the holding assembly substantially consists of the holding device 21, the spring element 22 and the actuating element 23.

The forme cylinder 06, which is described by way of example, can be embodied in such a way that several, preferably identical printing formes 01 can also be arranged on its shell surface 07. For example, up to six, and preferably either two or four plate-shaped printing formes 01, can be placed side-by-side in the axial direction of the forme cylinder 01. It is also possible that more than one printing forme 01 can be attached to the forme cylinder 06, in the direction of its circumference. For example, two grooves 08, extending axially with respect to the forme cylinder 06, and each with assigned openings 09, can be provided, which two grooves 08 are arranged offset, in respect to each other, by 180°, at the circumference of the forme cylinder 06. With this configuration of the forme cylinder 06 with two printing formes 01, which are arranged one behind the other along its circumference, the leading edge 03 of one printing forme 01 is fastened in one groove 08, while the trailing end 04 of the same printing forme 01 is fastened in the other groove 08. This also applies to the remaining printing forme, or formes arranged on this forme cylinder 06. The printing formes 01, which are arranged side-by-side in the axial direction of the forme cylinder 06, can also be offset with respect to each other, for example either individually or in groups, by respectively half the length L of the printing forme 01. This, however, requires that additional grooves 08 with associated openings 09, or at least that portions of additional grooves 08 with openings 09, have been cut into the forme cylinder 06 and are arranged along the circumference of the forme cylinder 06, for example offset by 90° with respect to the previously described grooves 08 and openings 09.

Figure 3:
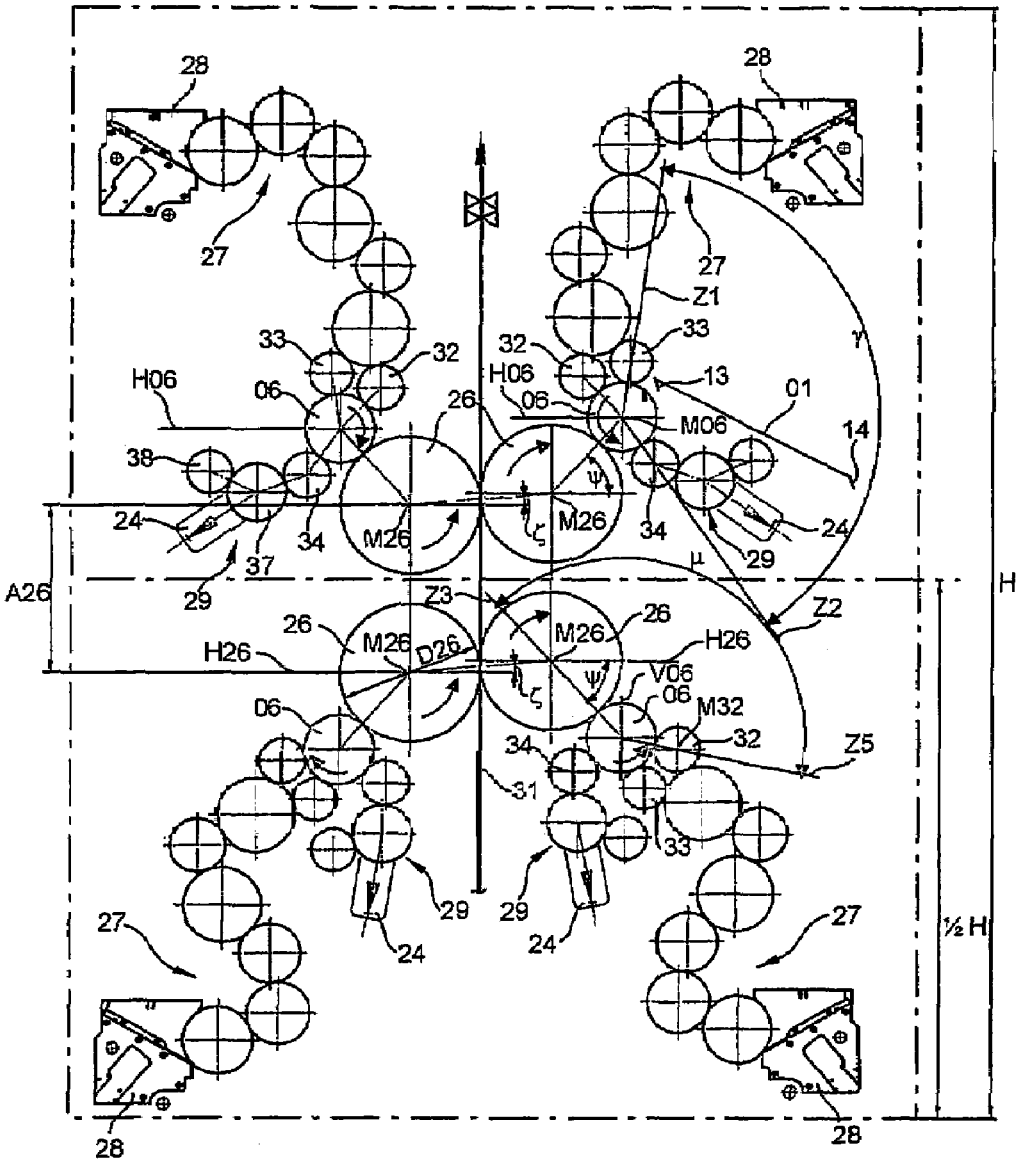

Without restricting the present invention, the description of the invention will be continued in the context of an example of a rotary printing press which is suited for newspaper printing, and having for example, at least one printing unit for 2/2-printing with four printing groups. Two printing groups are arranged vertically on top of each other on both sides of a material 31 to be imprinted, which is conducted vertically through the printing units, as shown in FIG. 3. Each printing group has a single size forme cylinder 06 and a double-size transfer cylinder 26. The diameter and the circumference of the forme cylinder 06 are respectively each only half the size of that of the associated transfer cylinder 26. The forme cylinders 06 and transfer cylinders 26 belonging to the same printing unit are preferably embodied structurally identical in each one of the four printing groups that constitute the printing unit. Since the printing unit preferably operates in accordance with an offset print method, the transfer cylinder 26 is, in particular, embodied as a rubber blanket cylinder 26. Such printing units configured for 2/2-printing are, in actual use, often stacked on top of each other to form a tower of eight and are used for 4/4-printing, and in particular are used for multi-color printing. Preferably, the printing unit is embodied as an H-printing unit. It can also be configured as a satellite printing unit with a further cylinder that is common to all of the printing groups of this printing unit, such as a common counter-pressure cylinder. However, as represented in FIGS. 3 to 7, the printing unit preferably is operated in accordance with the rubber-to-rubber printing method. The transfer cylinders 26 of two adjoining printing groups between which the material 31 to be imprinted moves, have been placed against each other, as seen in FIG. 3. In any case, a distance A26 between two print locations, i.e. the spacing of contact points between one of the transfer cylinders 26 and the material 31 to be imprinted, of two successive printing groups, which are arranged vertically above each other in the printing unit, is as short as possible. This distance A26 corresponds to the same dimension by which the centers M26 of the transfer cylinders 26 of these two printing groups, arranged vertically on top of each other, are distant from each other. For example, the distance A26 amounts to between 105% and 150% of the diameter D26 of the transfer cylinder 26, preferably between 120% and 130%, and in particular 125% of this diameter.

A multi-roller inking system 27, which, for example is configured as a film-type inking system 27 having an ink fountain 28, as well as a dampening system 29, such as, for example, a spray-dampening system 29 having a spray nozzle beam 24, are assigned to each of the forme cylinders 06. Each dampening system 29 consists of a roller train of several rollers 34, 37, 38 lined up with each other, and is preferably embodied with three rollers, but alternatively could also be embodied with four rollers. The dampening system 29, the inking system 27 and the transfer cylinder 26 are preferably grouped around the forme cylinder 06 of each printing group of the printing unit in such a way, that, in the course of its rotation during the printing process, the forme cylinder 06 initially picks up dampening medium from the dampening system and thereafter receives ink from the inking system, and then transfers that ink to the transfer cylinder 26. For this reason, and because of the traveling direction of the material 31 to be imprinted while it is passing through the printing unit, in the example of a printing unit represented in FIG. 3, the roller train of the dampening system 29 is arranged on the inside in each of the printing units in the printing groups located lower in the printing unit, i.e. on the side of the respective forme cylinder 06 facing the material 31 to be imprinted. The roller train of the dampening system 29 is arranged on the outside in each of the printing units in the upper printing groups of the printing unit, i.e. on the side of the respective forme cylinder 06 facing away from the material 31 to be imprinted. This may be seen by referring to FIG. 3.

Figure 4:
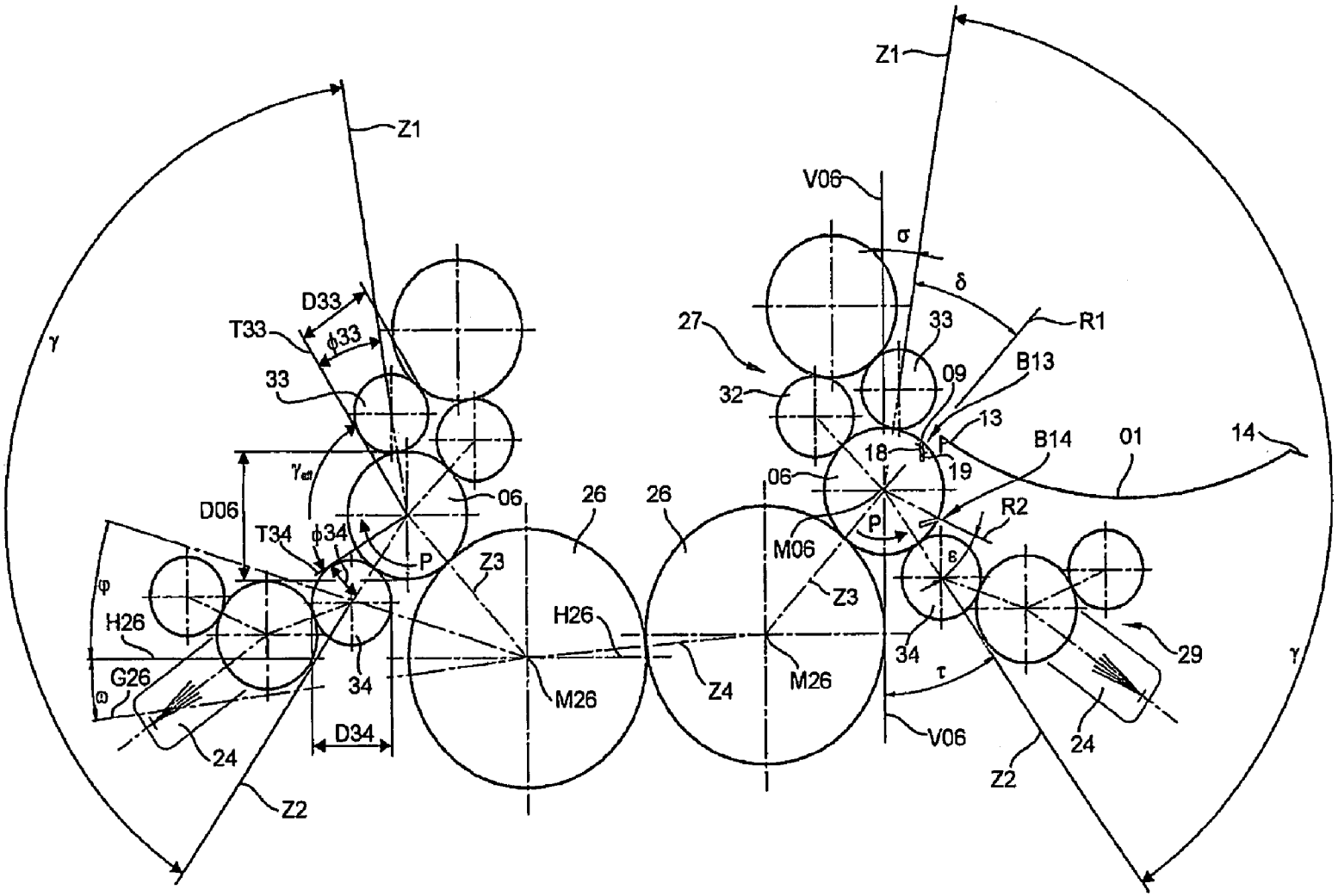

As a whole, a printing unit with the shortest possible distance A26 between its successive print locations advantageously has a lower structural size H, which is often desired in actual use. However, problems, which are caused by such a reduced structural space between the printing groups which are arranged vertically on top of each other, and in particular in the vertically upper printing groups, in the arrangement of their outside located dampening systems 29 can arise, if easy access to the respective forme cylinder 06 is to be maintained and, at the same time, if the forme cylinder 06 has only a small diameter D06, as shown in FIGS. 3 and 4. Thus, the application rollers 32, 33, 34 of the inking system 27 and of the dampening system 29, which application rollers 32, 33, 34 are to be placed against the forme cylinder 06 and whose diameters are D32, D33, D34, and are each respectively at least 50%, and preferably between 60% and 70% of the diameter D06 of the forme cylinder 06, together with the double-size transfer cylinder 26, which is working together with the forme cylinder 06, already claim a large portion of the relatively small circumference of the single-size forme cylinder 06. The result is that only very little free space remains for use in bringing a printing forme 01 against the forme cylinder 06. The problem becomes even more serious because the printing forme 01 has folded suspension legs 13, 14, which cannot be inserted in any arbitrary manner, but which must be inserted only in strictly defined angular positions, with respect to the openings 09 cut into the forme cylinder 06, into these openings 09 and fastened there.

For a further, more detailed explanation, FIG. 3 shows, by way of example, an H-printing unit bordered by dashed lines, which H-printing unit is provided with four printing groups and which has a total vertical structural height H. A printing form 01 to be mounted on the forme cylinder 06, which is represented in the printing group at the upper right in FIG. 3, is brought to the forme cylinder 06 with its suspension legs 13, 14 folded at its ends 03, 04 coming from the right in the drawing. The material 31 to be imprinted, preferably a web 31 of material, and in particular a paper web 31, is conducted, in the example shown in FIG. 3, vertically upwardly through the printing unit. The printing unit is substantially identically, and is therefore symmetrically, constructed on both sides of the path taken through the printing unit by the material 31 to be imprinted. Because of this identical structure, a detailed description of the half of the printing unit, which is on the left in the drawing, can be omitted. In FIG. 3, arrows for the direction of rotation indicate the production direction P of the forme cylinders 06 and the direction of rotation of the transfer cylinders 26. The forme cylinder 26 can have a right- or a left-running production direction P.

In a printing unit having a forme cylinder 06 with a comparatively small diameter D06 of, such as, for example, less than 200 mm, accessibility to the shell surface 07 of the forme cylinder 06, which accessibility is required for set-up work, for example, and in particular for a change of the printing forme 01, is considerably reduced by the ink application rollers 32, 33 of the inking system 27 and by the at least one dampening fluid application roller 34 of the dampening system 29, which rollers 32, 33, 34 are placed against the forme cylinder 06. To improve this accessibility, the ink application rollers 32, 33 and the dampening fluid application roller 34, which are placed against the forme cylinder 06, and particularly in the printing groups situated at the top of the printing unit, i.e. in the printing groups arranged above an auxiliary line passing horizontally through the printing unit at approximately half of its structural height H, are arranged spaced apart from each other for providing improved servicing of the respective forme cylinder 06. The particular ink application roller 33 and the dampening fluid application roller 34, having the least spacing distance between them, in the production direction P of the forme cylinder 06 and which are, in general, located the farthest away from the transfer cylinder 26, and in a cross section, such as represented in FIGS. 3 to 7, for example and, at least in their operational state, form, starting at the center M06 of the forme cylinder 06, a preferably obtuse opening angle γ with their respective center lines Z1, Z2 with the forme cylinder 06 of up to 180°. This opening angle γ has a value preferably within the range of 110° to 150°, for example. A straight line, which is called a center line Z1, Z2, passes through the centers of two circles, and in this case actually passes through the center M06 of the circular cross-sectional surface of the forme cylinder 06 and through the center M33 of the ink application roller 33 or the center M34 of the dampening fluid application roller 34. At these print locations, the inking system 27, with all its rollers, is preferably located above a horizontal line H06 extending through the center M06 of the forme cylinder 06, while the dampening system 29, with all its rollers 34, 37, 38, is preferably arranged below this horizontal line H06, as seen in FIG. 3.

Figure 5:
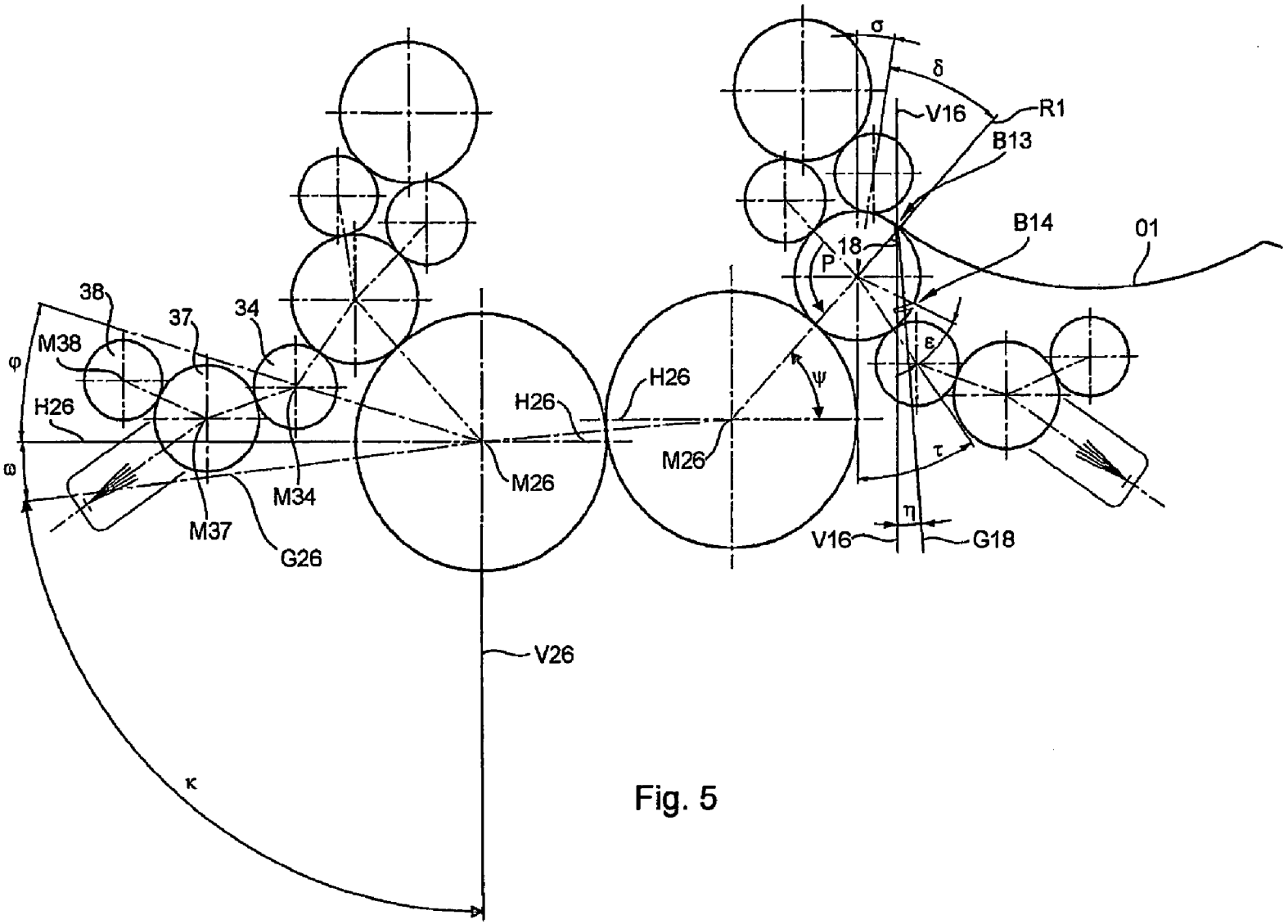

FIGS. 4 and 5 each respectively show sections of the printing unit in accordance with FIG. 3.

A printing forme 01 is represented, by way of example, in FIGS. 3 to 5, which printing forme 01 has a suspension leg 13, angled or folded at 45°, at is leading edge 03. Printing forme 01 has, on its trailing end 04, a suspension leg 14, angled or folded at 135°. The walls 18, 19, which extend into the interior of the forme cylinder 06 at the edge 16, which is in front in the production direction P of the forme cylinder, of the opening 09, and at its rear edge 17 located opposite edge 16, are accordingly configured in such a way that a positive connection of the suspension legs 13, 14, by their resting against these walls 18, 19, is possible. As FIGS. 3 and 4 show, the leading edge 03 of the printing forme 01 is brought to the forme cylinder 06 within the obtuse opening angle γ, which obtuse opening angle γ is delimited by the center lines Z1, Z2. The printing forme 01, which is structured to be flexible, can be bent over its length L, if this bending makes the engagement of the suspension leg 13 on its leading edge 03, for example, easier.

In a first operating position B13 of the forme cylinder 06, which first operating position the forme cylinder 06 can assume by being appropriately rotated, the suspension leg 13 at the leading edge 03 of the printing forme 01 comes into engagement with the forme cylinder opening 09, as seen in FIG. 5, so that the leading edge suspension leg 13 comes to rest against the wall 18 extending from the front edge 16. In a further, second operating position B14 of the forme cylinder 06, which, as a rule, differs from the first operating position B13 and which again is assumed by appropriate forme cylinder rotation, the suspension leg 14 of the trailing end 04 of the printing forme 01 also comes into engagement with the opening 09, so that the trailing end suspension leg 14 comes to rest against the wall 19 extending from the rear edge 17, so that both suspension legs 13, 14 are now in the opening 09, a configuration which is not specifically represented. At the time of the attainment second operating position B14 of the forme cylinder 06, the greatest portion of the printing forme 01 has already been drawn onto the shell surface 07 of the forme cylinder 06, preferably over more than two-thirds of its length L, and in particular over approximately 80% of that length. Both of the operating positions B13, B14 are located within a section of a circle formed by the opening angle γ in relation to the shell surface 07 of the forme cylinder 06, and their respective positions will be explained more precisely in what follows.

In an embodiment of the printing forme 01 with a suspension leg 14 which is folded obtusely at its trailing end 04, and with a correspondingly embodied forme cylinder 06, the operating positions B13, B14 of the forme cylinder 06 have preferably been selected to be such that the respective suspension leg 13, 14 of the printing forme 01 can be manually inserted, as easily as possible, by an operator into the opening 09. For example, an advantageous first operating position B13 of the forme cylinder 06 results, if this first operating position β13 has been selected to be such that the engagement of the leading end suspension leg 13 of the printing forme 01, with the forme cylinder opening 09, takes place at a time at which an opening angle δ located inside the opening angle γ is less than 90°, wherein the opening angle δ is delimited by a radially extending line R1, which connects the center M06 of the forme cylinder 06 with the edge 16 of the opening 09 which, in the production direction P of the forme cylinder 06, lies in front, and by that center line Z1 which, in the production direction P of the forme cylinder 06, is closest to the radially extending line R1. It is advantageous to select the opening angle δ to be such that it has a value in the range between 20° and 35°, and is preferably less than 30°. This opening angle δ is shown in FIGS. 4 and 5.

If it is necessary to introduce the trailing end suspension leg 14 of the printing forme 01 manually by an operator into the opening 09, it is recommended that the second operating position B14 of the forme cylinder 06 be selected such that the engagement of the suspension leg 14 at the trailing end 04 of the printing forme 06 takes place when a further opening angle $\epsilon$, which is also located within the opening angle $\gamma$, is less than 90°, wherein the opening angle $\epsilon$ is delimited by a radially extending line R2, which connects the center M06 of the forme cylinder 06 with the edge 17 of the opening 09 which, in the production direction P of the forme cylinder 06, lies in the rear, and by that center line Z2 which, opposite the production direction P of the forme cylinder 06, is closest to the radially extending line R2. It is advantageous to select the opening angle $\epsilon$ to be such that it has a value in the range between 20° and 35°, and is preferably approximately 30°. The opening angle $\epsilon$ is also shown in FIGS. 4 and 5.

It can also be seen in FIG. 4 that the free space facing toward the forme cylinder 06, and which is provided by the opening angle $\gamma$ is actually further restricted because of the physical extension of the ink application roller 33 and the physical extension of the dampening fluid application roller 34. The greater the diameter D33 of the ink application roller 33, or the greater the diameter D34 of the dampening agent application roller 34 is, in relation to the diameter D6 of the forme cylinder 06, the less the actually available free space usable, for example, for changing the printing forme 01, becomes. The actually available free space is located inside a section of a circle defined by an effective opening angle $\gamma_{eff}$ in relation to the shell surface 07 of the forme cylinder 06. The effective opening angle $\gamma_{eff}$ results from reducing the opening angle $\gamma$ by subtracting the angle areas $\phi$33, $\phi$34, which are occupied by the ink application roller 33 and the dampening fluid application roller 35, in accordance with the following trigonometric equation:

$$\gamma_{eff}=\gamma-\phi 33-\phi 34=\arcsin\{D33/(D06+D33)\}-\arcsin\{D34/D06+D34)\},\text{ wherein}$$

$\gamma_{eff}$=effective opening angle of the free space for access to the forme cylinder 06, $\gamma$=the theoretically maximum opening angle of the free space existing between the center lines Z1, Z2 for access to the forme cylinder 06, $\phi$33=an opening angle, located within the opening angle gamma, between the center line Z1 and a tangent line T33 extending through the center M06 of the forme cylinder 06 and touching the ink application roller 33, $\phi$34=an opening angle, located within the opening angle gamma, between the center line Z2 and a tangent line T34 extending through the center M06 of the forme cylinder 06 and touching the dampening fluid application roller 34, D06=diameter of the forme cylinder 06, D33=diameter of the ink application roller 33, D34=diameter of the dampening fluid application roller 34.

It is advantageous, in accordance with the present invention, if the effective opening angle $\gamma_{eff}$ is at least 60°, and in particular approximately 90°.

FIG. 5 shows a printing forme 01 to be mounted, and having a suspension leg 13 on its front end 03. In the first operating position B13 of the forme cylinder 06, the leading end suspension leg 13 is placed against the edge 16 of the opening 09 which is in front, in the production direction P, of the forme cylinder 06. It can also be seen in FIG. 5 that this operating position B13 has been advantageously selected if the wall 18 extending from the front edge 16 lies within the opening angle $\gamma$, and a straight line G18 applied to it forms an acute opening angle $\eta$, starting at the front edge 16, in relation to a vertical line V16, which is tangent with the front edge 16, wherein the opening angle $\eta$ preferably is less than 15°, and in particular is approximately 5°. The opening angle $\eta$ can extend in the same direction as the production direction P of the forme cylinder 06, i.e. the direction of rotation of the opening angle $\eta$ corresponds to the production direction P of the forme cylinder 06, but can also extend opposite to it.

Figure 6:
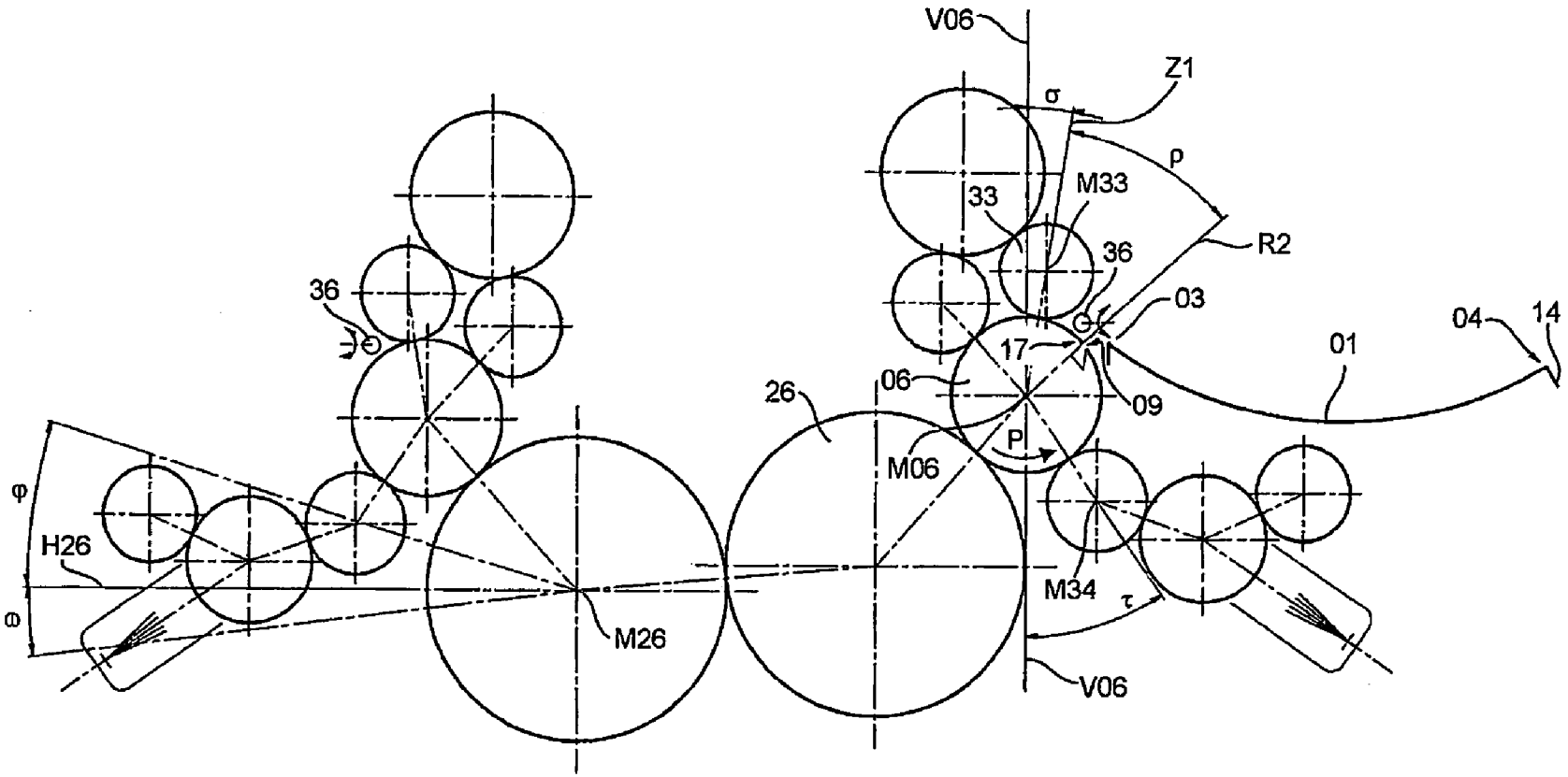
Figure 7:
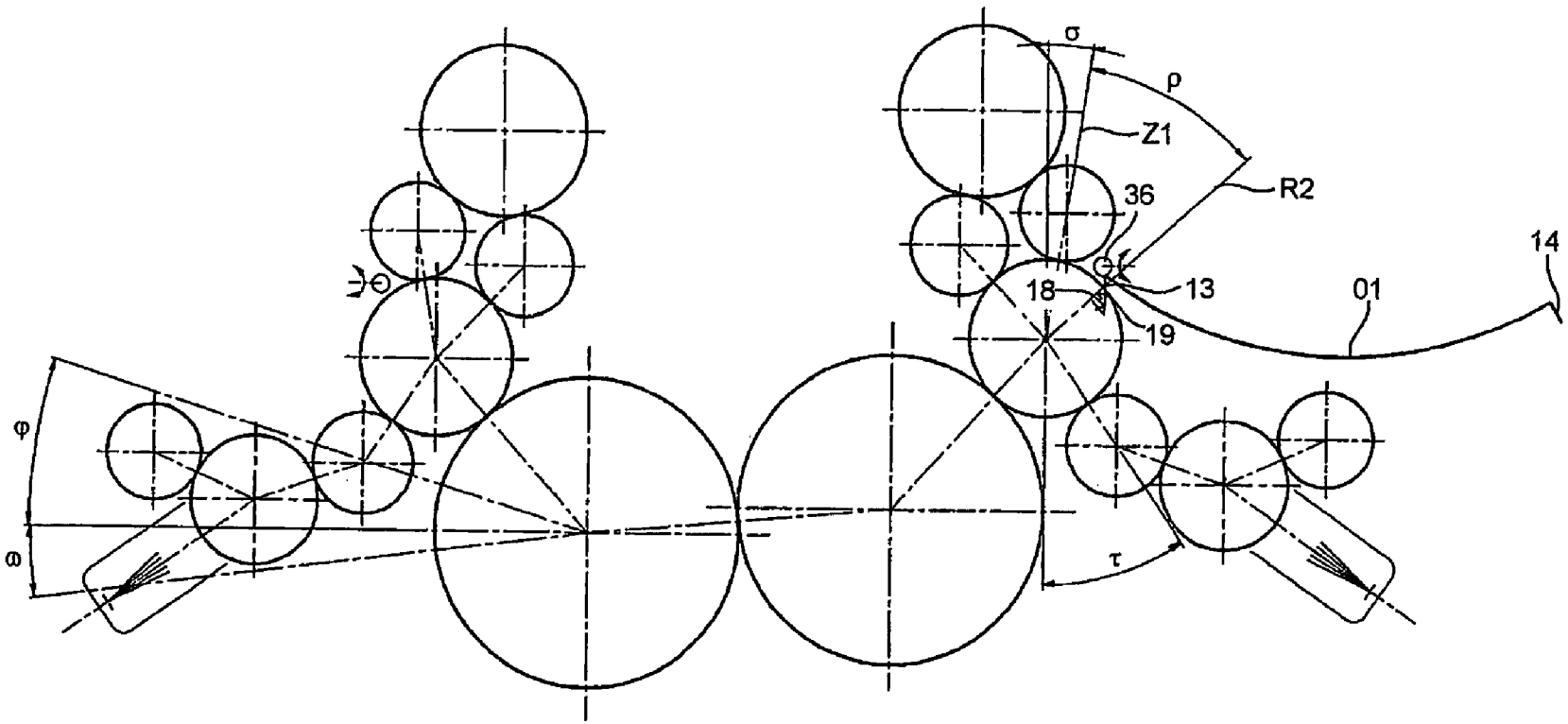

FIGS. 6 and 7 show a portion of a printing unit that is similar to that shown in FIG. 3, and with a pressure element 36 arranged to exert a pressure force on the forme cylinder 06, which pressure element 36 is, for example, embodied as a pressure roller 36 or as a pressure cylinder 36 and which is arranged in the axial direction in relation to the forme cylinder 06 and which can as well be placed against the forme cylinder 06 by an actuating element, not represented, and which can also be moved away from the forme cylinder 06 following the mounting of the printing forme 01. Placement of the pressure element 36 against or away from the forme cylinder 06 takes place by pivoting, for example, as indicated by the curved two-headed arrow shown in FIGS. 6 and 7. FIG. 6 shows a flexible printing forme 01 being brought toward the forme cylinder 06 which printing forme 06, however, is still spaced at a distance from the shell face 07 of the forme cylinder 06. In FIG. 7 it is shown that the printing forme 01 just engages the opening 09 with its folded suspension leg 13 formed on its front end 03 in order to place the leading edge suspension leg 13 against the wall 18 which is extending in the production direction P of the forme cylinder 06 from the front edge 16. That placement of the leading edge suspension leg 13 is aided by the pressure element 36 through the placement of the pressure element 36 against the shell face 07 of the forme cylinder 06 taking place at this moment, as well as by a roll-over and a rolling open of the printing form 01 on the shell face 07 following this placement of the leg 13 against the wall 18.

The pressure element 36 is preferably situated close to the ink application roller 33, as well as within an acute opening angle $\rho$, wherein the opening angle $\rho$ is delimited by the radially extending line R2, which connects the center M06 of the forme cylinder 06 with the edge 17 of the opening 09 which is in the rear, in the production direction P of the forme cylinder 06, and that center line Z1, which, in the production direction P of the forme cylinder 06, is closest to the radially extending line R2. It is advantageous to select the opening angle $\rho$ in such a way that it has a value within the range, for example, between 20° and 45°, and is preferably less than 40°. In actual use, because of the narrow slit width S of the opening 09, the opening angle $\rho$ and the previously described opening angle $\delta$ have approximately the same size.

The printing forme 01 that is represented in FIGS. 6 and 7 has a shape as represented in FIGS. 1 and 2. In particular, the suspension leg 14 formed on its rear end 04 is folded at approximately right angles from the flat contact face 02. The walls 18, 19 extending from the edges 16, 17 of the opening 09 into the interior of the forme cylinder 06 are matched to the folded suspension legs 13, 14 of the printing forme 01. The two suspension legs 13, 14 of a printing forme 01 can be introduced into the opening 09 practically in the same operating position of the forme cylinder 06, substantially as defined by the position of the radially extending line R2, of the forme cylinder 06. Thus, the suspension leg 13 at the front end 03 of the printing forme 01 is inserted into the opening 09. The printing forme 01 is then wound off, in its full length L, on the shell face 07 of the forme cylinder 06 and is rolled off. This can take place, depending on the length L of the printing forme 01, after almost a full rotation of the forme cylinder 06, for example. The trailing suspension leg 14, which is located at the rear end 04 of the printing forme 01, can engage the opening 09 practically in the same operating position of the forme cylinder 06. A printing forme 01 with a suspension leg 14 at its rear end 04, which is folded approximately at right angles, is also suited to be automatically brought to the forme cylinder 06 by the use of a not specifically represented feeding device, such as, for example, a printing forme magazine.

As can be seen in FIGS. 4 to 7, the positions of the central lines Z1, Z2 preferably diverge from a vertical line V06 which is passing through the center M06 of the forme cylinder 06. Thus, the center line Z1, which is extending through the ink application roller 33, forms an acute angle σ, preferably extending or opening in a direction that is leading away from the transfer cylinder 26, with the vertical line V06 passing through the center M06 of the forme cylinder 06, and whose value preferably is less than 40°, and in particular is less than 30°. The center line Z2, which is extending through the dampening fluid application roller 34, has an acute opening angle τ, opening preferably in a direction leading away from the transfer cylinder 26, with the vertical line V06 passing through the center M06 of the forme cylinder 06, whose value preferably lies in the range of 25° and 45°, for example.

FIGS. 3 to 7 show that the dampening system 29 is preferably arranged in such a way that the centers M34, M38 of at least the first and last rollers 34, 38, which rollers 34, 38 are a part of the roller train of the dampening system 29, and preferably the centers M34, M37, M38 of all of the rollers 34, 37, 38, which are parts of the dampening system 29, are located within an acute opening angle ϕ starting at the center M06 of the forme cylinder 06, wherein a horizontal line H26 passing through the center M26 of the transfer cylinder 26 delimits the opening angle ϕ at the bottom. Preferably, the opening angle ϕ is less than 45°, and in particular is less than 20°. A dampening fluid application roller 37, which lies lowest underneath the horizontal line H26, is preferably located within an acute opening angle ω, which extends from the center M26 of the transfer cylinder 26, which directly borders the opening angle ϕ and is therefore upwardly delimited by the horizontal line H26. The opening angle ω preferably is less than 30°, and in particular is less than 15°.

FIGS. 3 to 7 also show that a central line Z3 extending through the forme cylinder 06 and the transfer cylinder 26, together with the horizontal line H26 extending through the center M26 of the transfer cylinder 26, forms an acute opening angle Ψ starting at the center M26 of the transfer cylinder 26, wherein this opening angle Ψ has a value in the range of 40° and 60°, for example, and preferably between 45° and 50°.

In the H-printing unit represented in FIGS. 3 to 7, the centers M26 of the transfer cylinders 26 which are rolling off on each other, are not located on the same horizontal line H26. Instead, a center line Z4 extending through these two transfer cylinders 26, as seen in FIG. 4, together with the respective horizontal line 26 extending through a center M26 of one of the transfer cylinders 26, forms an acute opening angle ζ, starting at the center M26 of one of the two transfer cylinders 26, wherein this opening angle ζ has a value of up to 15°, and is preferably less than 10°.

In the printing group described in FIGS. 3 to 7, the inking system 27 and the dampening system 29, which are assigned to each forme cylinder 06, are arranged in such a way that a sufficient accessibility to the transfer cylinder 26 also exists when the printing group is in that operating state, in which an ink application roller 33 and a dampening fluid application roller 34 have been placed, spaced apart from each other, against the forme cylinder 06, and the forme cylinder 06 has been placed against the transfer cylinder 26. This accessibility to the transfer cylinder 26 makes the re-tightening or the exchange of a dressing which has been applied to, or which is to be applied to, the transfer cylinder 26, such as a rubber printing blanket, easier. As previously described, the exchange of a printing forme 01, to be exchanged on the forme cylinder 06, takes place in an area of the forme cylinder 06 between the ink application roller 33 and the dampening fluid application roller 34 which are placed against the forme cylinder 06. The dampening system 29 which, as a rule, has several, such as, for example, three dampening system rollers 34, 37, 38, is positioned at the forme cylinder 06 in such a way that an opening angle κ, starting at the center M26 of the transfer cylinder 26, is formed between a vertical line V26 extending through the center M26 of the transfer cylinder 26-and a straight line G26, which is, in particular, a directional line 26 starting at the center M26 of the transfer cylinder 26, wherein the straight line G26 constitutes a tangent at the lowest dampening system roller 34, 37, 38 of the dampening system 29, as seen in FIG. 5. In this case, the opening angle κ has a value of at least 45°, and preferably of at least 60°. The proposed arrangement offers advantages, in particular for printing groups wherein the transfer cylinder 26 has at least twice the diameter and circumference of that of the forme cylinder 06.

In accordance with FIG. 3, in a printing unit of a printing press with at least two printing groups which are arranged vertically above each other on each side of a material 31 to be imprinted, and which material 31 is being conducted vertically through the printing unit, the transfer cylinder 26 and the ink application roller 32 which are closest in the direction of rotation of the forme cylinder 06 of the lower printing group form, at least in their operating state wherein they are placed against the shell face 07 of their forme cylinder 06, in a cross section, an obtuse opening angle μ between their respective center lines Z3, Z5, together with their forme cylinder 06, wherein the center line Z5 extends through the center M06 of the forme cylinder 06 and the center M32 of the ink application roller 32 located closest to the transfer cylinder 26 in the direction of rotation of the forme cylinder 06, wherein the feeding of a printing forme 01, which is to be mounted on the shell face 07 of the forme cylinder 06, on the forme cylinder 06 takes place within the opening angle μ located between the ink application roller 32 and the transfer cylinder 26, and wherein the opening angle μ between the two center lines Z3, Z5 preferably has a value in the range between 95° and 150°. In actual use, the opening angle μ is delimited by the center line Z5 extending through the center M32 of the ink application roller 32 and the vertical line V06 extending through the center M06 of the forme cylinder 06.

While preferred embodiments of a printing group of a printing unit, consisting of two printing groups which are placed vertically above each other, in a printing machine and printing unit in accordance with the present invention have been set forth fully and completely hereinabove, it will be apparent to one of skill in the art that various changes in, for example, the specific structure of the forme cylinders and of the transfer cylinders, the drives for these cylinders and for the inking systems and dampening systems and the like could be made without departing from the true spirit and scope of the present invention which is accordingly to be limited only by the following claims:

What is claimed is:

1. A printing unit of a printing press comprising:

at least upper and lower printing couples arranged vertically one above the other and including upper and lower cooperating printing groups;

a material to be printed, said material passing vertically between said upper and lower cooperating printing groups;

an upper forme cylinder in each said upper printing group and having an upper forme cylinder center, an upper forme cylinder circumferential surface and an upper forme cylinder diameter;

an upper inking system including at least one upper ink application roller adapted to contact said upper forme cylinder;

an upper dampening system including a plurality of aligned upper dampening rollers and at least one upper dampening fluid application roller adapted to contact said upper forme cylinder;

an upper transfer cylinder cooperating with said upper forme cylinder, said upper transfer cylinder having an upper transfer cylinder diameter that is twice said upper forme cylinder diameter;

an upper ink application roller center line defined by a center of said upper ink application roller and said upper forme cylinder center when said upper ink application roller is in contact with said upper forme cylinder;

an upper dampening fluid application roller center line defined by a center of said upper dampening fluid application roller and said upper forme cylinder when said upper dampening fluid application roller is in contact with said upper forme cylinder;

an upper obtuse opening angle formed by said upper ink application roller center line and said upper dampening fluid application roller center line, said upper obtuse opening angle defining an upper free space on said upper forme cylinder, said upper free space facing away from said material to be printed, said upper free space being adapted for feeding a first printing forme to be mounted on said shell surface of said upper forme cylinder, said upper forme cylinder, said upper inking system, said upper dampening system and said upper transfer cylinder forming each said upper printing group;

means for bringing said first printing forme to said upper free space for mounting of said first printing forme on said shell surface of said upper forme cylinder;

a lower transfer cylinder having a lower transfer cylinder center line defined by a center of said lower transfer cylinder in said lower one of each of said printing groups and a center of a lower forme cylinder of each said lower printing group;

a lower forme cylinder center line defined by a center of said lower forme cylinder of said lower printing group and an associated lower ink application roller of said lower printing couple, said lower ink application roller lying closest, in a production direction of rotation of said lower forme cylinder, said lower transfer cylinder of said lower printing group;

a lower obtuse opening angle defined by said lower transfer cylinder center line and said lower forme cylinder center line in said lower printing unit, said lower obtuse opening angle defining a lower free space, said lower free space facing away from said material to be printed, said lower free space being adapted for feeding a second printing forme to said lower forme cylinder; and means for bringing said second printing forme to said lower free space for mounting of said second printing forme on said lower forme cylinder.

2. The printing unit of claim 1 wherein said lower obtuse opening angle is between 95° and 150°.

3. The printing unit of claim 1 wherein each said forme cylinder includes an axially extending slit on said shell surface.

4. The printing unit of claim 1 wherein a dampening system of said lower printing group is placed adjacent said lower forme cylinder on a side of said lower forme cylinder facing said material to be printed.

5. The printing unit of claim 1 further including an acute opening angle formed by a horizontal line through a center of said upper transfer cylinder and centers of at least a first and a last one of said upper dampening rollers in said plurality of upper dampening rollers in said upper dampening system of each said upper printing group, said centers of said at least first and last ones of said plurality of upper dampening rollers being above said horizontal line, said acute opening angle being less than 45°.

6. The printing unit of claim 5 wherein said acute opening angle includes the center of all of said plurality of upper dampening rollers in said upper dampening system.

7. The printing unit of claim 5 further including a pressure element adapted to contact said shell surface of said upper forme cylinder and being arranged, in a direction of rotation of said upper forme cylinder, between said upper ink application roller and said upper dampening fluid application roller and within an included acute angle within said upper obtuse opening angle, said included acute angle being located near said upper ink application roller and bordering said upper ink application roller center line in each said upper printing group.

8. The printing unit of claim 1 including a groove on each said upper forme cylinder shell surface and adapted to fasten ends of a printing forme to be mounted on each said upper forme cylinder, said printing forme having at least one folded suspension leg on a leading edge of said printing forme, and a pressure element adapted to be placed against said shell surface of said upper forme cylinder for introduction of said folded suspension leg of said printing forme into said upper forme cylinder groove, said pressure element being arranged, in a direction of rotation of said forme cylinder, between said upper ink application roller and said upper dampening fluid application roller within an included acute angle located within said upper obtuse opening angle and near said upper ink application roller, said included acute opening angle bordering said upper ink application roller center line, each said upper forme cylinder, said upper inking system, said upper dampening system and said upper transfer cylinder forming each said printing group.

9. The printing unit of claim 8 wherein said included acute opening angle is between 20° and 45°.

10. The printing unit of claim 8 wherein said included acute opening angle is less than 40°.

11. The printing unit of claim 1 wherein each said forme cylinder is arranged in an H-shaped printing unit.

12. The printing unit of claim 1 wherein said printing unit operates as a 2/2-printing unit.

13. The printing unit of claim 1 further including a third printing group having a third printing group transfer cylinder, said third printing group transfer cylinder being placed in a horizontal direction against said upper printing group transfer cylinder, a material to be imprinted being passed between said upper printing group transfer cylinder and said third printing group transfer cylinder.

14. The printing unit of claim 1 wherein each said forme cylinder diameter is less than 200 mm.

15. The printing unit of claim 1 wherein diameters of each of said ink application roller and of said dampening fluid application roller are at least one half of each said forme cylinder diameter.

16. The printing unit of claim 1 wherein diameters of each said ink application roller and said dampening fluid application roller are between 50% and 70% of each said forme cylinder diameter.

17. The printing unit of claim 1 wherein each said dampening system is a spray-dampening system.

18. The printing unit of claim 1 wherein a vertical spacing distance between said transfer cylinders of said upper and lower cooperating printing groups is between 105% and 150% of each said transfer cylinder diameter.

19. The printing unit of claim 18 wherein said vertical spacing distance is between 120% and 130% of each said transfer cylinder diameter.

20. The printing unit of claim 19 wherein said vertical spacing distance is 125% of each said transfer cylinder diameter.

21. The printing unit of claim 1 further including an acute opening angle formed by a horizontal line through a center of at least a first and a last one of said upper dampening rollers of said plurality of upper dampening rollers in said upper dampening system, said center of said at least first and last ones of said plurality of upper dampening rollers being above said horizontal line, said acute opening angle being less than 45°.

22. The printing unit of claim 21 wherein a center of another one of said upper dampening rollers lies within said acute opening angle.

23. The printing unit of claim 1 wherein said upper free space is provided within an effective opening angle resulting from the equation:

$$\text{gamma}_{eff}=\text{gamma}-\phi 33-\phi 34=\arcsin\{D33/(D06+D33)\}-\arcsin\{D34/D06+D34)\},$$

wherein $\text{gamma}_{eff}$=effective opening angle of the upper free space for access to the upper forme cylinder 06, gamma=the theoretically maximum opening angle of said upper free space existing between said center lines Z1, Z2 for access to said upper forme, ϕ33=an opening angle, located within said opening angle gamma, between said center line Z1 and a first tangent line T33 extending through said upper forme cylinder center touching said upper ink application roller, ϕ34=an opening angle, located within said opening angle gamma, between said center line Z2 and a second tangent line T34 extending through said upper forme cylinder center and touching said upper dampening fluid application roller, D06=diameter of said upper forme cylinder 06, D33=diameter of said upper ink application roller 33, and D34=diameter of said dampening fluid application roller 34.

24. The printing unit of claim 23 wherein said effective opening angle is at least 60°.

25. The printing unit of claim 23 wherein said effective opening angle is 90°.

26. The printing unit of claim 1 further including at least one opening on said shell surface and including spaced front and rear walls extending axially along said upper forme cylinder and being spaced circumferentially in a production direction of said upper forme cylinder.

27. The printing unit of claim 26 further including said first printing forme having leading and trailing edge suspension legs and wherein said trailing edge suspension leg is engagable with said rear wall.

28. The printing unit of claim 27 wherein said engagement of said trailing edge suspension leg against said rear wall is within a rear acute edge angle defined by a line formed as an extension of said rear wall and a vertical line extending tangent to an edge of said rear wall.

29. The printing unit of claim 28 wherein said rear acute edge angle is between 20° and 35°.

30. The printing unit of claim 27 wherein engagement of said trailing suspension leg occurs after said first printing forme has been unrolled on said upper forme cylinder.

31. The printing unit of claim 30 wherein said upper forme cylinder is rotated through one full revolution during said unrolling of said first forme cylinder.

32. The printing unit of claim 26 further including a front suspension leg and rear suspension leg on said first printing forme, said rear suspension leg extending at right angles to said first printing forme, said walls being matched to said suspension legs, engagement of said suspension legs with said walls taking place in the same operating position of said upper forme cylinder.

33. The printing unit of claim 26 wherein a width of said at least one opening is less than 5 mm.

34. The printing unit of claim 33 wherein said width of said at least one opening is between 1 mm and 3 mm.

35. The printing unit of claim 1 wherein said first printing forme has at least one folded suspension leg at a leading edge of said first printing forme.

36. The printing unit of claim 1 wherein all of said upper dampening rollers are arranged above a straight line extending through a center of said upper transfer cylinder and which is tangent with a surface of a one of said upper dampening rollers which is arranged lowest on a side of said upper transfer cylinder mounted opposite to a production direction of said upper transfer cylinder and wherein, in a production direction of said upper transfer cylinder, an angle of at least 45° is formed by said straight line and a vertical line extending through said center of said upper transfer cylinder.

37. The printing unit of claim 36 wherein said angle is at least 60°.

* * * * *